US005391861A

United States Patent [19]

Ooyama et al.

[11] Patent Number: 5,391,861

[45] Date of Patent: Feb. 21, 1995

[54] HEATER FOR SHEET MATERIAL

[75] Inventors: Shingo Ooyama; Shigeo Ota; Fumiaki Tagashira, all of Kyoto, Japan

[73] Assignee: Rohm Co., Ltd., Kyoto, Japan

[21] Appl. No.: 144,493

[22] Filed: Nov. 1, 1993

Related U.S. Application Data

[62] Division of Ser. No. 998,767, Dec. 29, 1992, abandoned, which is a division of Ser. No. 896,593, Jun. 10, 1992, abandoned.

[30] Foreign Application Priority Data

Jul. 25, 1991 [JP] Japan ..... 3-186352

[51] Int. Cl.[6] ..... H05B 3/16

[52] U.S. Cl. ..... 219/543; 219/216; 338/320

[58] Field of Search ..... 219/216, 543; 338/217, 338/293, 319, 320, 325; 355/285, 289, 290

[56] References Cited

U.S. PATENT DOCUMENTS

| | | | |
|---|---|---|---|
| 2,758,256 | 8/1956 | Eisler | 338/295 |
| 3,878,362 | 4/1975 | Stinger | 219/543 |
| 4,401,881 | 8/1983 | Saito | 219/216 |
| 4,628,187 | 12/1986 | Sekiguchi et al. | 219/543 |
| 4,752,672 | 6/1988 | Grise | 219/543 |
| 4,774,492 | 9/1988 | Shier | 338/320 |
| 4,845,344 | 7/1989 | Price et al. | 219/547 |
| 4,931,627 | 6/1990 | Watts | 219/543 |
| 5,068,517 | 11/1991 | Tsuyuki | 219/543 |
| 5,197,329 | 3/1993 | Grundy | 338/320 |

FOREIGN PATENT DOCUMENTS

| | | | |
|---|---|---|---|
| 0143047 | 12/1978 | Japan | 219/543 |
| 55-28064 | 2/1980 | Japan | 355/285 |
| 315563 | 1/1991 | Japan | 346/76 PH |
| 1354703 | 5/1974 | United Kingdom | 219/543 |

*Primary Examiner*—Bruce A. Reynolds
*Assistant Examiner*—Gregory L. Mills
*Attorney, Agent, or Firm*—William H. Eilberg

[57] ABSTRACT

A heater comprises an insulating substrate which carries a parallel pair of conductor strips. The respective conductor strips are spaced from each other transversely thereof but electrically connected to each other by a plurality of heating resistors which are spaced longitudinally of the respective conductor strips. Advantageously, the heating resistors are arranged or configured so that the heater will have a temperature distribution which is equalized longitudinally.

6 Claims, 5 Drawing Sheets

HEATER FOR SHEET MATERIAL

This application is a division of application Ser. No. 07/998,767, filed Dec. 29, 1992, now abandoned, which is a division of application Ser. No. 07/896,593, filed Jun. 10, 1992, which is now abandoned.

BACKGROUND OF THE INVENTION

1. Field of the Invention

This invention relates generally to heaters. More specifically, the present invention relates to a linear heater which can be advantageously used in an office automation apparatus such as a photocopier or electrographic printer for fixing images on a paper sheet for example.

2. Description of the Prior Art

Various types of linear heaters are known for fixing images (deposited toner) on a paper sheet in photocopiers or electrographic printers (e.g. laser beam printer). Typical examples include a lamp heater and a roller heater.

However, the lamp heater and roller heater are equally disadvantageous in that there is a limitation in reducing size (thickness) and cost. Further, the lamp heater is easily damaged due to the nature of material, whereas the roller heater has a complicated structure due to the necessity of incorporating plural heating elements within the roller.

To eliminate the problems of the conventional heaters, U.S. Pat. No. 5,068,517 to Tsuyuki et al (Patented: Nov. 26, 1991; Filed: Aug. 22, 1989) proposes a strip heater which comprises an elongate insulating substrate having a surface provided with a printed resistor strip. Both ends of the resistor strip are enlarged and coated with silver for connection to a power source. The resistor strip, which is made of e.g. silver-palladium alloy, generates heat when a current is passed therethrough. The resistor strip is covered by a glass layer to provide smooth contact with a paper sheet.

Obviously, the strip heater of the above U.S. patent is very simple in arrangement. Further, the strip heater can be made very thin by reducing the thickness of the substrate. However, the strip heater is still disadvantageous in the following points.

First, since the resistor strip is continuous, it becomes inoperative even if it is broken or disconnected only at one portion thereof. Thus, in such an event, the strip heater as a whole must be replaced.

Secondly, the enlarged ends of the resistor strip, which are coated with silver, are the portions where heat dissipation occurs most easily. Thus, if the resistor strip is made to have a constant width over the entire length thereof, an uneven temperature distribution will result in which the surface temperature of the resistor strip is lower near the enlarged ends than at the center. This problem itself can be solved if the width of the resistor strip is made to reduce progressively toward the enlarged ends, as taught in the above U.S. patent. However, such a solution gives rise to a new problem that the narrower end portions of the resistor strip are more easily broken because, in spite of the reduced width, the narrower end portions generate a greater amount of heat than the central portion.

SUMMARY OF THE INVENTION

It is, therefore, an object of the present invention to provide a linear heater which is capable of operating for heat generation even if the heater is partially broken.

Another object of the present invention is to provide a linear heater which is capable of providing an equalized temperature distribution without increasing the likelihood of breakage.

A further object of the present invention is to provide an improved heating unit for an apparatus, particularly a photocopier or electrographic printer, which requires a heating operation for image fixation for example.

According to one aspect of the present invention, there is provided a heater comprising an insulating substrate which carries a first conductor strip and a second conductor strip spaced transversely from the first conductor strip, the respective conductor strips are electrically connected to each other by a plurality of heating resistors which are spaced longitudinally of the respective conductor strips.

With the arrangement described above, the heating resistors are arranged in parallel relation to each other. Thus, the heater is still operative for heat generation even if part of the heating resistors is broken. Further, the temperature distribution of the heater can be equalized simply by arranging the heating resistors more densely near the ends of the heater than near the center or by making the heating resistors wider or shorter near the ends of the heat than at the center. Other arrangements may be adopted for equalizing the temperature distribution longitudinally of the heater.

According to another aspect of the present invention, there is provided a heating unit for an apparatus requiring a heating operation relative to a sheet material, the heating unit comprising an insulating substrate which carries a first conductor strip and a second conductor strip spaced transversely from the first conductor strip, the respective conductor strips are electrically connected to each other by a plurality of heating resistors which are spaced longitudinally of the respective conductor strips.

Other objects, features and advantages of the present invention will become apparent from the following detailed description of the preferred embodiments given with reference to the accompanying drawings.

DETAILED DESCRIPTION OF THE PREFERRED EMBODIMENTS

Figure 1:
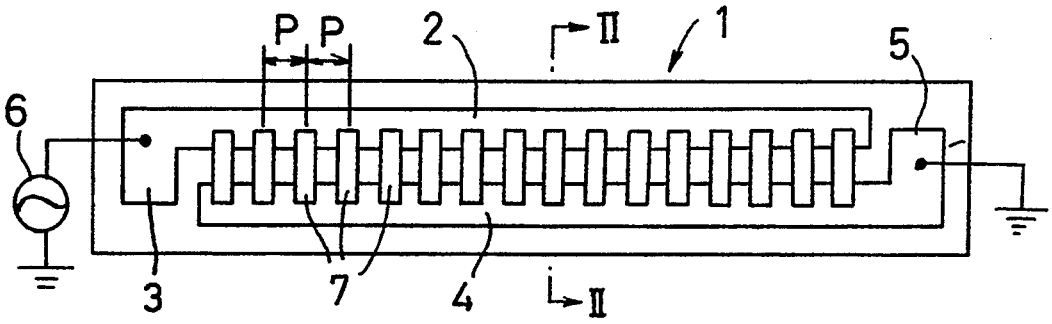
FIG. 1 is a plan view showing a heater according to a first embodiment of the present invention.
Figure 2:
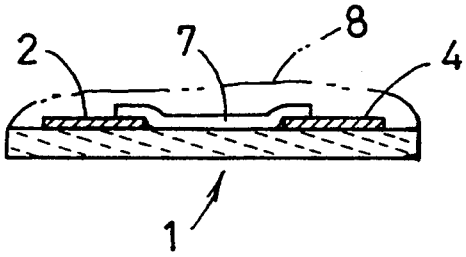
FIG. 2 is a sectional view taken along lines II—II in FIG. 1.
Figure 3:
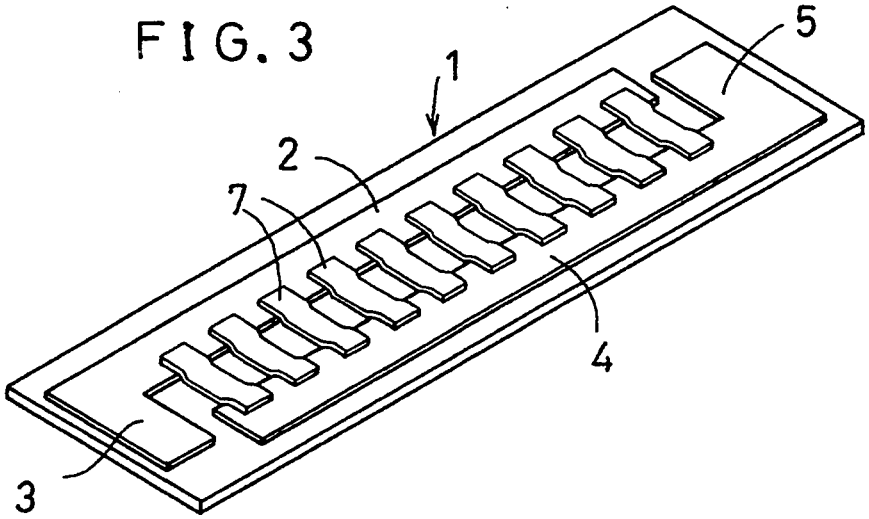
FIG. 3 is a perspective view showing the same heater.

Referring now to FIGS. 1–3 showing a heater according to a first embodiment of the present invention, there is illustrated an elongate substrate 1 made of a heat-resistant insulating material such as ceramic. The substrate has an upper surface formed with a first printed conductor strip 2 having an enlarged connection terminal 3, and a second printed conductor strip 4 similarly having an enlarged connection terminal 5. The respective conductor strips 2, 4 extend longitudinally of the substrate 1 in parallel to each other. The respective terminals 3, 5 are located near the opposite ends of the substrate 1 and connected to an alternating power source 6.

According to the first embodiment, the substrate 1 also carries a plurality of printed heating resistors 7 arranged at a constant pitch P (see FIG. 1) longitudinally of the substrate and connecting between the respective conductor strips 2, 4. Further, a protective layer 8 is formed on the substrate to cover the respective conductor strips 2, 4 together with the resistors 7, as shown in FIG. 2.

The first and second conductor strips 2, 4 together with the respective connection terminals 3, 5 may be formed by depositing a paste of e.g. gold or silver on the substrate surface and thereafter baking the deposited paste. Similarly, the heating resistors 7 may be formed by depositing a pasty resistor material such as ruthenium oxide or silver-palladium alloy and thereafter baking the deposited resistor material. The protective layer 8 may be made of glass for example to have a smooth surface for contact with paper.

The respective heating resistors 7 are electrically parallel to each other and subjected to a same voltage across the respective conductor strips 2, 4. Thus, in operation, the respective heating resistors simultaneously generate a same amount of heat if they are equal in resistivity (i.e. width and thickness).

Obviously, due to the parallel arrangement, even if one or more of the resistors become inoperative, the remaining resistors are still operative for heat generation. Thus, there is no need to replace the heater as a whole.

The conductor strips 2, 4 and the heating resistors 7 may be formed indirectly on the surface of the substrate 1 via an intervening glaze layer (not shown). However, it is preferable that these printed elements be formed directly on the substrate surface, as shown in FIG. 2. The reason for this is described with reference to FIGS. 4 and 5.

Figure 4:
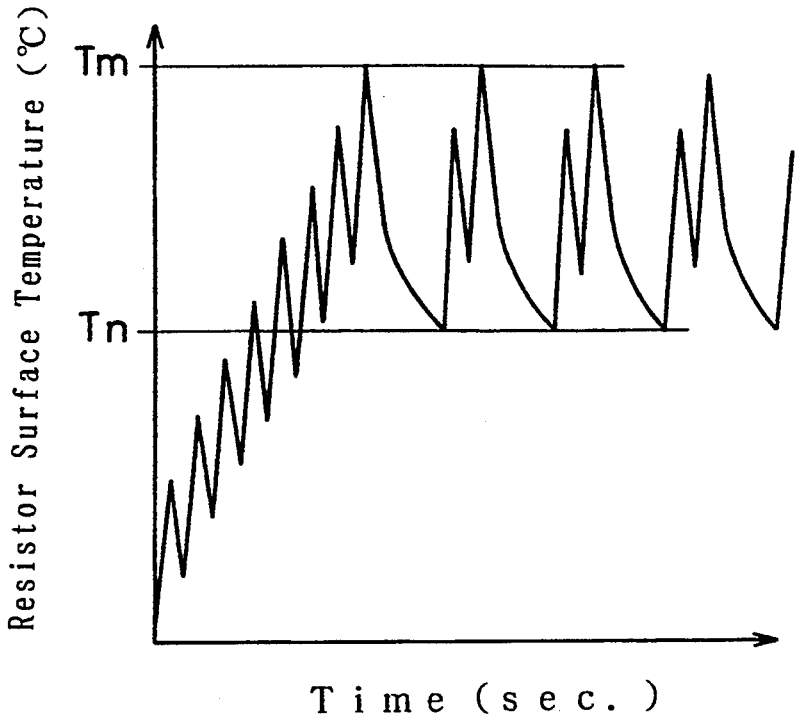
FIG. 4 is a graph showing the heating characteristic of the same heater when incorporating an intervening glaze layer.

FIG. 4 shows the heating characteristic obtainable for each heating resistor when the resistor is formed indirectly on a substrate surface via an intervening glaze layer. At the initial stage of operation, the surface temperature of the resistor continues to rise until a steady operating state is reached. In the steady state, the surface temperature fluctuates between a maximum operating temperature Tm and a minimum operating temperature Tn due to the alternating nature of the power source. The difference between Tm and Tn has been experimentally confirmed to be about 200° C., and this larger difference is considered attributable mainly to the heat retaining nature of the glaze layer.

Figure 5:
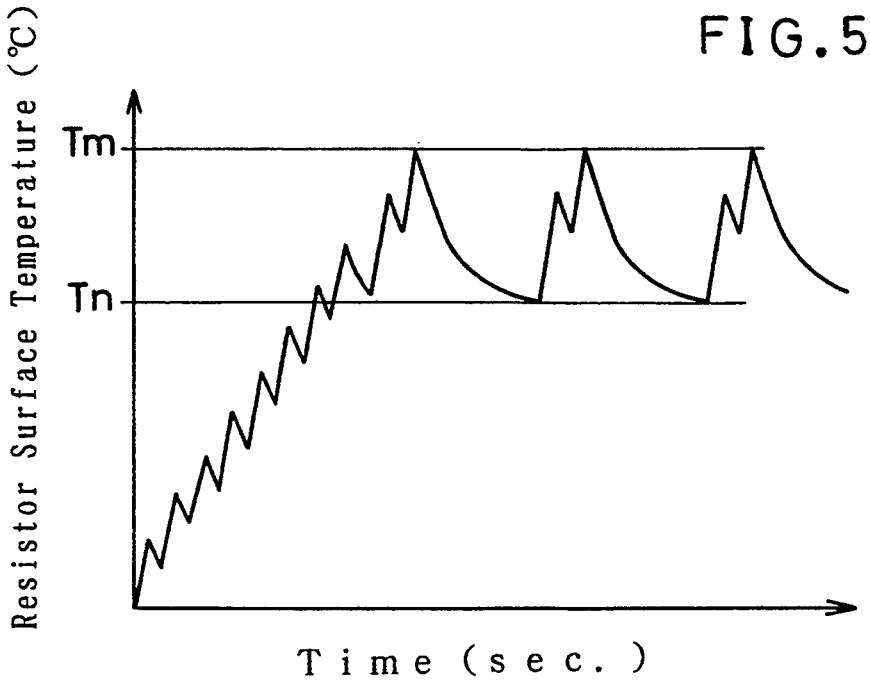
FIG. 5 is graph showing the heating characteristic of the same heater without an intervening glaze layer.

FIG. 5 shows the heating characteristic obtainable for each heating resistor 7 when the resistor is formed directly on the substrate surface, as shown in FIG. 2. In this case, again, the surface temperature of the resistor 7 fluctuates between a maximum operating temperature Tm and a minimum operating temperature Tn in the steady operating state, but the difference between Tm and Tn reduces to about 100° C.

Comparison between FIGS. 4 and 5 clearly suggests that the heating resistors 7 should be formed directly on the substrate surface in order to minimize the temperature fluctuation which would inevitably result from the use of the AC power source 6. However, for applications which allow a large temperature fluctuation, the substrate surface may be formed with an intervening glaze layer.

Figure 6:
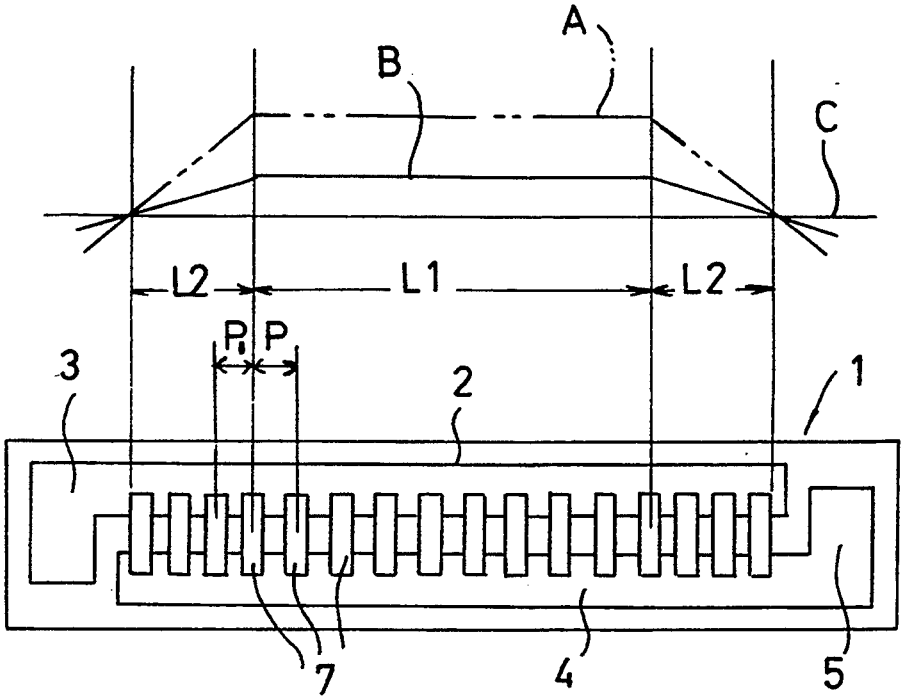
FIG. 6 is a plan view showing a heater according to a second embodiment of the present invention.

FIG. 6 shows a heater according to a second embodiment of the present invention. The heater of the second embodiment differs from that of the first embodiment only in that those heating resistors 7 located adjacent to the respective connection terminals 3, 5 are arranged at a smaller pitch P1 than the remaining resistors (pitch P).

As described above, all of the heating resistors 7 are subjected to a same voltage due to the parallel arrangement. Thus, the respective heating resistors generate an equal amount of heat if they are equal in resistivity (i.e., width and thickness).

However, since the enlarged connection terminals 3, 5 of the respective conductor strips 2, 4 act to dissipate heat very easily, those of the heating resistors 7 located adjacent to the connection terminals 3, 5 lose the generated heat more easily than the remaining resistors. As a result, if all of the heating resistors 7 are arranged at a constant pitch P (as in the first embodiment of FIGS. 1–3), a temperature distribution will result wherein the temperature is sharply higher at the central portion of the heater than at the end portions thereof, as indicated by a chain line A in FIG. 6. Thus, if the end portion temperature of the heater is adjusted to become higher than a required minimum operation temperature (indicated by a horizontal line C in FIG. 6), the central portion temperature must be rendered unnecessarily high.

According to the second embodiment, on the other hand, those of the heating resistors 7 located adjacent to the connection terminals 3, 5 of the respective conductor strips 2, 4 are arranged more densely than the remaining heating resistors, thereby compensating for the increased heat dissipation at the connection terminals 3, 5. Thus, the heater will have a temperature distribution which is more equalized longitudinally of the heater, as indicated by a solid line B in FIG. 6.

Figure 7:
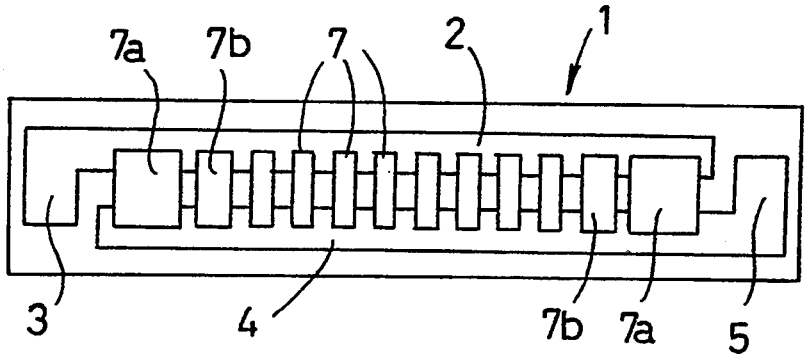
FIG. 7 is a plan view showing a heater according to a third embodiment of the present invention.

FIG. 7 shows a heater according to a third embodiment of the present invention. The heater of this embodiment differs from the first embodiment of FIGS. 1–3 only in that two kinds of widened end heating resistors 7*a*, 7*b* are provided near the connection terminals 3, 5 of the respective conductor strips 2, 4. In the embodiment of FIG. 7, one kind of end heating resistors 7*a* are wider than the other kind of end heating resistors 7*b* which are still wider than the remaining heating resistors 7.

As is well known, the amount of heat generation is proportional to the product of voltage (V) and current (i). However, in the case of the parallel arrangement employed for the present invention, the voltage is equal for all of the heating resistors 7, 7a, 7b. Then, the amount of heat generation depends only on the current which is proportional to the width of the respective heating resistors (i.e., inversely proportional to the resistivity). Thus, the end heating resistors 7a, 7b produce more heat than the remaining resistors 7 to compensate for higher heat dissipation near the connection terminals 3, 5, thereby equalizing the temperature distribution longitudinally of the heater.

Figure 8:
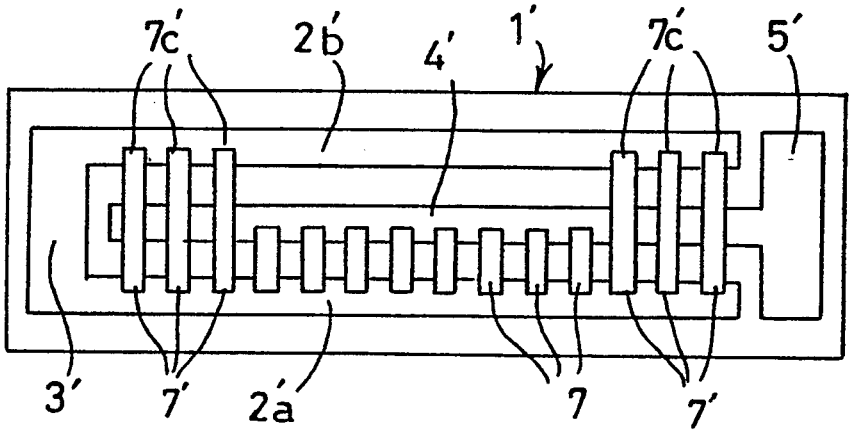
FIG. 8 is a plan view showing a heater according to a fourth embodiment of the present invention.

FIG. 8 represents a heater according to a fourth embodiment of the present invention. The heater of this embodiment includes an insulating substrate 1', similarly to the foregoing embodiments.

The substrate 1' carries a first conductor strip 2a' having an enlarged connection terminal 3', and a second conductor strip 4' having an enlarged connection terminal 5'. The substrate 1' further carries a third conductor strip 2b' which is connected commonly to the connection terminal 3' of the first conductor strip 2a'.

The first and second conductor strips 2a', 4' are parallelly connected to each other by central heating resistors 7 and end heating resistors 7'. Further, each of the end heating resistors 7' has an excess portion 7c' which connects between the second conductor strip 4' and the third conductor strip 2b'.

According to the fourth embodiment, the excess portions 7c' of the end heating resistors 7' provide additional heat generation to compensate for higher heat dissipation near the respective connection terminals 3', 5'. As a result, the temperature distribution of the heater as a whole is equalized longitudinally thereof.

Figure 9:
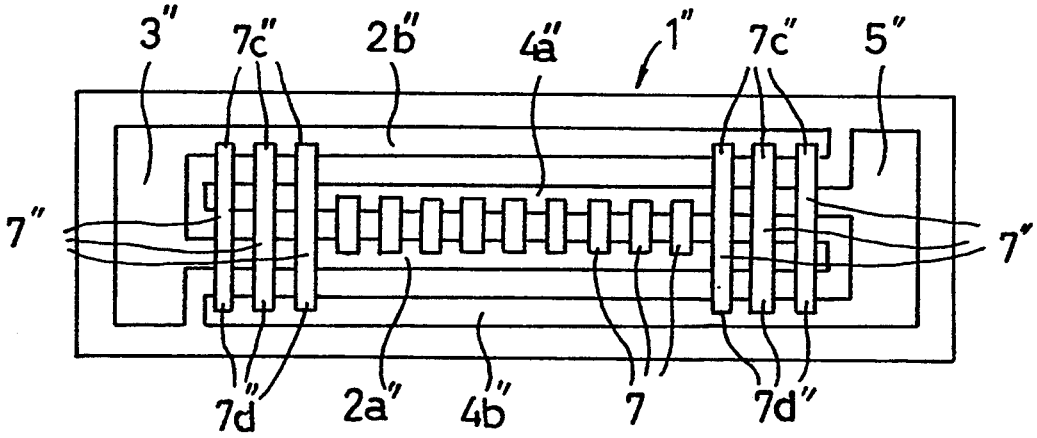
FIG. 9 is a plan view showing a heater according to a fifth embodiment of the present invention.

FIG. 9 illustrates a heater according to a fifth embodiment of the present invention. Again, the heater of this embodiment includes an insulating substrate 1'', similarly to the foregoing embodiments.

The substrate 1'' carries a first conductor strip 2a'' having an enlarged connection terminal 3'', and a second conductor strip 4a'' having an enlarged connection terminal 5''. The substrate 1'' further carries a third conductor strip 2b'' connected commonly to the connection terminal 3'' of the first conductor strip 2a'', and a fourth conductor strip 4b'' connected commonly to the connection terminal 5'' of the second conductor strip 4a''.

The first and second conductor strips 2a'', 4a'' are parallelly connected to each other by central heating resistors 7 and end heating resistors 7''. Further, each of the end heating resistors 7'' has a first excess portion 7c'' which connects between the second conductor strip 4a'' and the third conductor strip 2b'', and a second excess portion 7d'' which connects between the first conductor strip 2a'' and the fourth conductor strip 4b''.

According to the fifth embodiment, the excess portions 7c'', 7d'' of the end heating resistors 7'' provide additional heat generation to compensate for higher heat dissipation near the respective connection terminals 3'', 5''. Thus, this embodiment provides substantially the same advantage as the fourth embodiment of FIG. 8.

Figure 10:
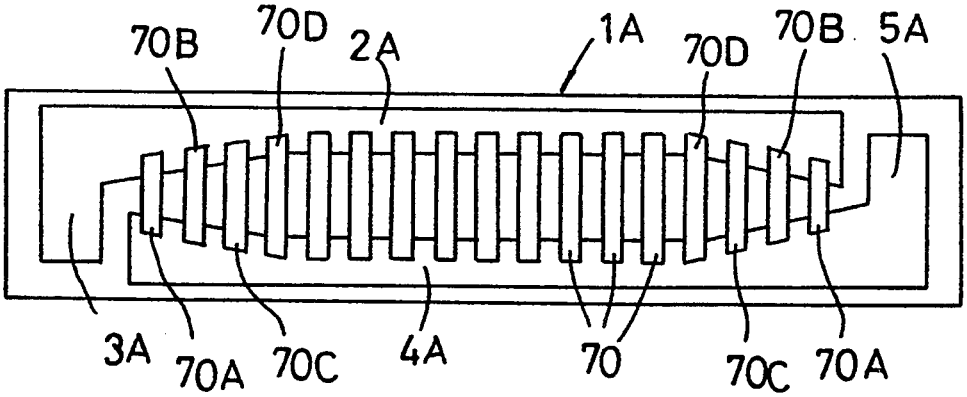
FIG. 10 is a plan view showing a heater according to a sixth embodiment of the present invention.

FIG. 10 shows a heater according to a sixth embodiment of the present invention. The heater of this embodiment includes an insulating substrate 1A which carries a first conductor strip 2A having a connection terminal 3A, and a second conductor strip 4A also having a connection terminal 5A, similarly to the first embodiment of FIGS. 1-3.

According to the sixth embodiment, the respective conductor strips 2A, 4A are parallel to each other. However, the spacing between the respective conductor strips 2A, 4A is constant only at the central portion of the heater but reduces progressively toward the respective connection terminals 3A, 5A. The thus configured conductor strips 2A, 4A are connected to each other by central heating resistors 70 having an equal length as well as by end heating resistors 70A-70D whose length reduces progressively toward the respective connection terminals 3A, 5A.

Since the current under a given voltage is inversely proportional to the length (i.e., resistance), the heat generation provided by the respective heating resistors 70, 70A-70D increases toward the respective connection terminals 3A, 5A where heat dissipation is accelerated. Thus, the heater of the sixth embodiment is capable of equalizing the temperature distribution longitudinally of the heater.

In the sixth embodiment of FIG. 10, it should be appreciated that all of the heating resistors 70, 70A-70D may be made to have an equal length as long as the spacing between the respective conductor strips 2A, 4A is made to reduce progressively toward the respective connection terminals 3A, 5A. In this case, only the effective length of the end heating resistors 70A-70D rather than the actual length thereof can be considered to reduce progressively toward the respective connection terminals 3A, 5A.

Figure 11:
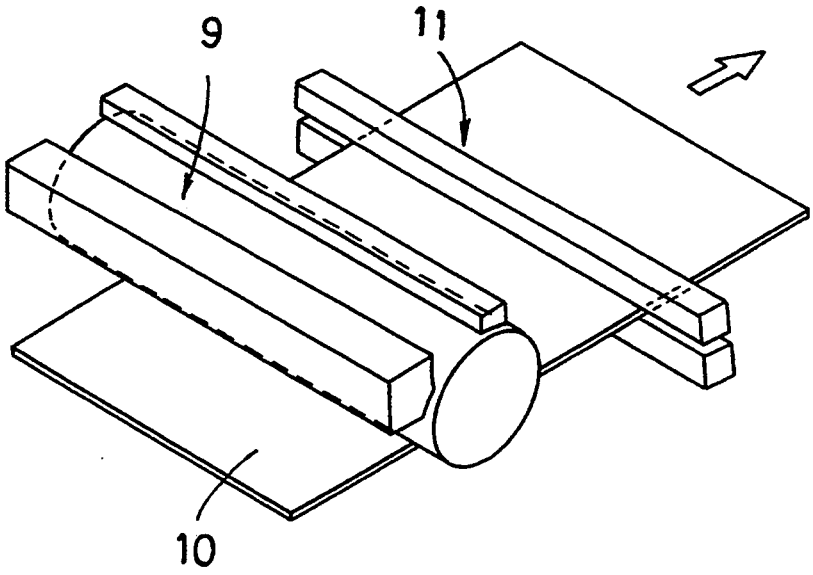
FIG. 11 is a plan view showing a principal portion of a photocopier which incorporates a heater of the present invention.

Either heater of the foregoing embodiments may be used as an image fixing heater for a photocopier, as shown in FIG. 11. Specifically, the photocopier comprises a transfer roll 9 which is held in contact with paper 10 for printing information thereto. The printed information or image is fixed at an image fixing unit 11 by heating the toner deposited on the paper 10.

Obviously, the heater of the present invention may be used as an image fixing heater for an electrographic printer as well. Further, it may be also used for purposes other than image fixation.

The present invention being thus described, it is obvious that the same may be varied in many ways. For instance, selected ones of the embodiments described above may be suitably combined to equalize the temperature distribution longitudinally of the heater. Such variations are not to be regarded as a departure from the spirit and scope of the the invention, and all such modifications as would be obvious to those skilled in the art are intended to be included within the scope of the following claims.

We claim:

1. A heater comprising an electrically insulating substrate which carries a first conductor strip and a second conductor strip spaced transversely from the first conductor strip, the respective conductor strips being electrically connected to each other by a plurality of heating resistors which are spaced longitudinally of the respective conductor strips and actuated simultaneously for heat generation, the heating resistors including a plurality of intermediate resistors electrically connecting only between the first and second conductor strips, the heating resistors also including a plurality of end resistors located adjacent to both ends of each conductor strip, wherein the substrate further carries a third conductor strip spaced transversely from the first and second conductor strips, each of the end resistors having an excess portion which connects between the second and third conductor strips.

2. The heater according to claim 1, wherein the first and third conductor strips are electrically connected to each other through a common connection terminal.

3. The heater according to claim 1, wherein the substrate further carries a fourth conductor strip spaced transversely from the first to third conductor strips, each of the end resistors having an additional excess portion which connects between the first and fourth conductor strips.

4. The heater according to claim 3, wherein the first and third conductor strips are electrically connected to each other through a common connection terminal, the second and fourth conductor strips being electrically connected to each other through another common connection terminal.

5. The heater according to claim 4, wherein the first to fourth conductor strips are formed directly on the substrate.

6. The heater according to claim 1, wherein the first to third conductor strips are formed directly on the substrate.

* * * * *